United States Patent [19]

Laurich-Trost

[11] 4,297,943

[45] Nov. 3, 1981

[54] CAGE ASSEMBLY FOR PRESS ASSEMBLY

[76] Inventor: Victor R. Laurich-Trost, 34600 McAfee Dr., Solon, Ohio 44139

[21] Appl. No.: 101,899

[22] Filed: Dec. 10, 1979

[51] Int. Cl.[3] ..... B30B 9/06

[52] U.S. Cl. ..... 100/129; 366/143

[58] Field of Search ..... 100/117, 145–150, 100/127–129; 425/84, 85, 189, 190, 208; 366/87, 79, 143

[56] References Cited

U.S. PATENT DOCUMENTS

| | | | |
|---|---|---|---|
| 2,138,670 | 11/1938 | Upton | 100/129 |
| 3,115,087 | 12/1963 | Ginaven | 100/129 |
| 3,593,655 | 7/1971 | Prescott | 100/117 |
| 3,982,483 | 9/1976 | Bird et al. | 100/148 |

FOREIGN PATENT DOCUMENTS

| | | | |
|---|---|---|---|
| 856145 | 3/1940 | France | 100/129 |

*Primary Examiner*—Peter Feldman

*Attorney, Agent, or Firm*—Watts, Hoffmann, Fisher & Heinke Co.

[57] ABSTRACT

A cage assembly for a mechanical press apparatus of the type for processing and extruding polymeric materials, the assembly including a pair of oppositely disposed and mating cage sections including window-like cage members each having a plurality of axially extending screen bar elements frictionally and resiliently mounted in a self-supporting relationship for dewatering or otherwise removing moisture from the processed polymeric material which can be quickly and easily installed and/or removed without tear-down of nor removal of the press and/or components thereof.

5 Claims, 8 Drawing Figures

CAGE ASSEMBLY FOR PRESS ASSEMBLY

BACKGROUND OF THE INVENTION

The invention relates generally to a mechanical screw press apparatus of the type for continuous operation to process and extrude polymeric materials for forming a pellet-like product which can thereafter be further processed, such as by baling or the like, into a further product, such as sheet, strip, or the like. The invention more specifically relates to a new and novel screw press cage assembly which may be located upstream of the extruder portion of the press which, in effect, provides a fluid discharge or vent section for dewatering and otherwise moving moisture from the polymeric process material.

Heretofore, various apparatus generally characterized as mechanical screw press devices have been provided for the removal of moisture, vapors, etc. from polymeric materials, and for the subsequent production of porous pellets or similar products from the processed polymeric material. Such devices have generally included a screw press having a screw press cage to which the polymeric material is advanced wherein the material is compressed and moved through the cage and then extruded through an extruder portion of the press to produce a product essentially free of moisture, vapors, etc., which is suitable for baling or for further processing into ultimate product form.

A typical prior art apparatus of this type for removing moisture are illustrated in U.S. Pat. Nos. 3,225,453; 3,382,538; 3,518,936; 3,574,891 and 3,672,641.

In such apparatus and/or process methods, a substantial amount of liquid, such as retained water, resides in the polymeric material at it discharges from the press.

In the past, it has been recognized that if a considerable amount of liquid, such as retained water, is retained in the polymeric material as it is delivered from the press, there results a relatively active discharge of liquid from the polymeric material. This occurrence results, as believed, from the pressure differential as the polymeric material is extruded from the press which, in turn, produced relatively small particles ("fines") formed from the polymeric material within the press. As will be seen, these "fines" act not only to contaminate, such as by clogging or the like, components of the press including the screw press cage assembly but also may contaminate the ultimate product to be produced for subsequent baling or the like. Accordingly, there exists a need for a screw cage assembly which can be quickly and easily cleaned and/or repaired in the event that some of the fluid apertures (vents) become blocked and/or clogged so as to minimize the amount of down-time of the press while these components are being cleaned, repaired, or replaced.

In the past, in such mechanical screw press apparatus difficulties have been encountered in respect to installation and/or removal of various components of the cage assemblies for purposes of cleaning, i.e. removal of the "fines," and for purposes of repair and/or replacement. For example, in prior apparatus it has been the requirement to disassemble the entire cage assembly, such as by unbolting the semi-circular cage sections, in order to have access to the interior of the cage assembly for cleaning, replacement and/or repair of the screw bar members or other components, for example. In such arrangements, the installation and/or removal of the cage screen sections was not only difficult because of the weight of the component parts but was time consuming to accomplish resulting in considerable machine down-time. Accordingly, such prior screw press apparatus did not incorporate cage assemblies for dewatering purposes or the like which lent themselves to effective and efficient replacement of the component parts for cleaning, repair or the like.

SUMMARY OF THE INVENTION

The present invention relates to a mechanical screw press of the type for processing polymeric materials including new and novel cage means defining elongated screen portions having fluid apertures or vent openings for removal of moisture from the processed polymeric material. The screen portions are defined by a pair of mating, semi-cylindrical cage sections adapted to be detachably connected together to define a unitary cylindrical cage configuration. Each cage section includes a window-like construction defined by a plurality of axially extending screen bar members held together in an arcuate arrangement by a plurality of resilient retainer elements. The retainer elements are constructed and arranged so as to provide predetermined and selective spacement between respective of the screen bar members to provide said aperatures and/or vent openings for controlling the egress of fluid, such as entrained water, from the processed polymeric material. The window-like constructions defined by the screen bar members are, in effect, of a unitary configuration held in place by fastener means so as to enable removal of the window-like constructions from the exterior of the press without having to remove, for example, the barrel of the press including the mating semi-cylindrical cage sections thereof.

In the invention, though only two mating semi-cylindrical cage sections have been illustrated, it will be understood that other members of such sections can be employed in accordance with the present invention. For example, one such cage section could be disposed at the bottom or underneath the barrel of the press to enable quick and easy removal of such section for the purposes of the invention. In addition, it will be understood that the window-like cage constructions could be of a solid configuration, utilized for heating and/or cooling as well as for dewatering purposes, as desired. The screen bar members are disposed in an arcuate or radial orientation to define a cylindrical chamber for dewatering the polymeric material to be processed. The screen bar members are radially spaced by wedge spacer elements in conjunction with resilient means to form the narrow oppositely extending aperatures or vent openings for dewatering purposes.

In the invention it is recognized that the window-like cage structure can be designed in various configurations. For example, the configuration may be a solid construction, for cooling and/or heating applications utilizing a manifold construction, and for the dewatering application.

From the foregoing, it will be seen that the present invention provides a new and novel window-like cage construction which can be quickly and easily assembled and/or removed for inspection of internal cage components, such as spiral flights, spacers, breaker bars, and the general condition of the press housing without taking the main assembly of the barrel apart. Such construction facilitates easier and less costly equipment, inspection, cleaning and general maintenance and especially reduces machine-time in respect to cleaning, repair and/or replacement of any cage components. Further, by this construction the window-like cage construction provides versatility in that it enables limited sequence changes on the extruder portion of the press. In addition, the aperatures, openings or slots defined by the screen bar members can be quickly and easily changed by simply varying the spacer thickness (shim) within specified limits, as desired.

DESCRIPTION OF THE PREFERRED EMBODIMENTS

Figure 1:
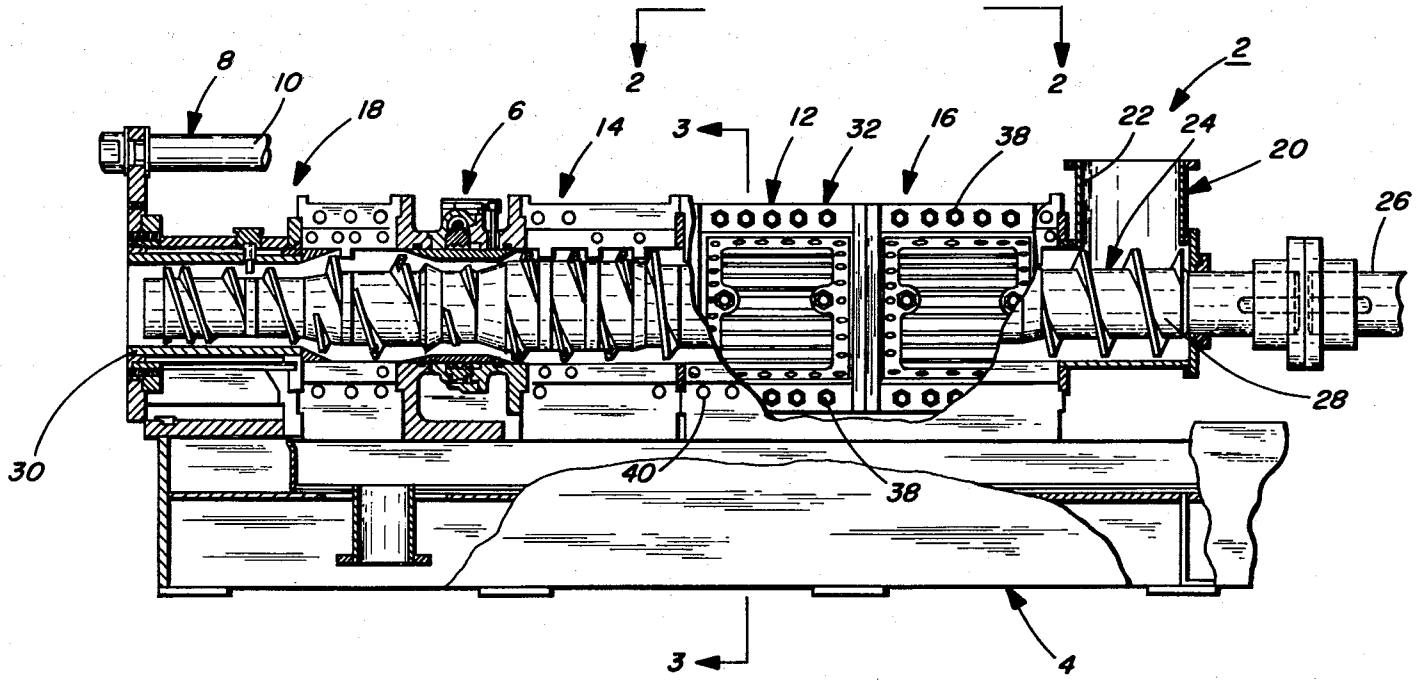
FIG. 1 is a fragmentary, elevational view of a screw press apparatus constructed in accordance with the invention with portions broken away and portions shown in vertical cross-section.
Figure 2:
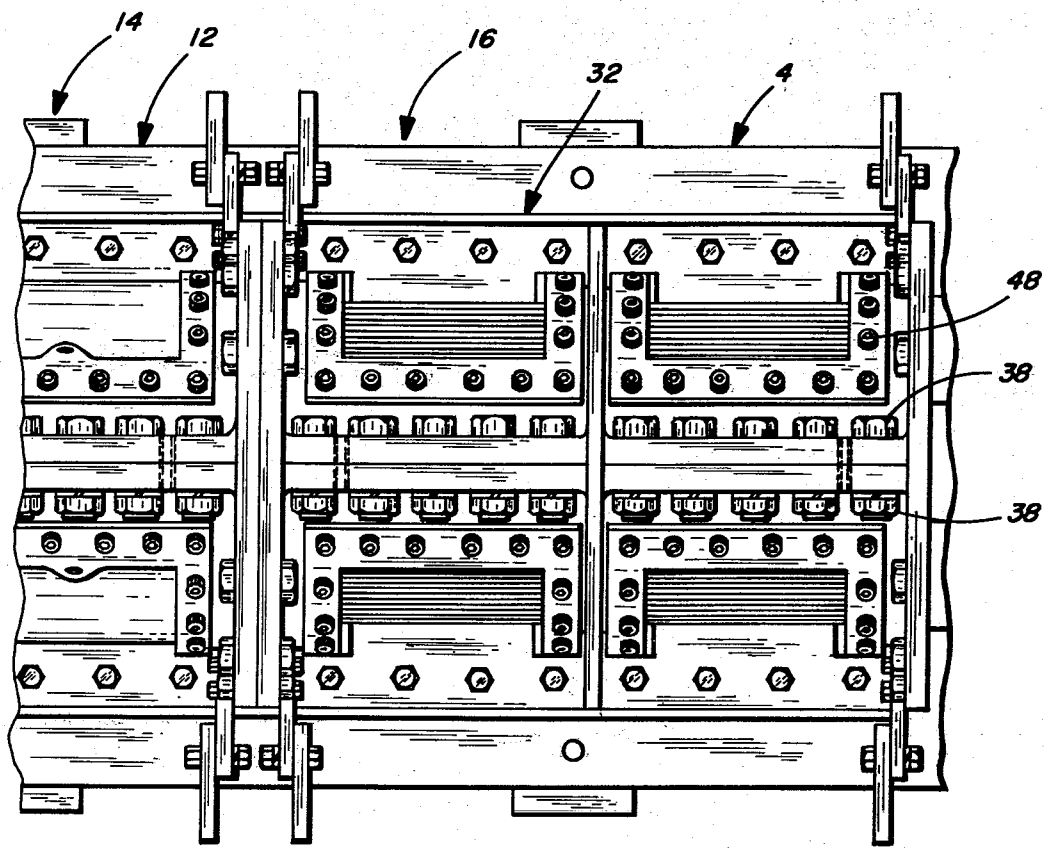
FIG. 2 is a fragmentary, top plan view, on an enlarged scale, looking in the direction of line 2—2 of FIG. 1.

Referring now again to the drawings and particular to FIG. 1 thereof, there is illustrated a screw press apparatus, designated generally at 2, of the invention. As shown, the apparatus generally includes a base frame structure 4 which mounts a gear housing 6 in an upwardly extending end support 8. The end support 8 may be rigidly connected to the housing 6 by tie bolts 10, as known in the art. An axially extending barrel 12 is supported by the frame and includes a plurality of gage sections 14 and 16 and an extruder discharge section 18. An inlet housing 20 is mounted on the inlet end of the barrel 12 and has an inlet opening 22 adapted to receive material to be processed in the press apparatus. An elongated worm assembly 24 extends through the barrel and includes a shaft 26 which may be connected to a suitable drive motor (not shown) through a reduction gear train located within the gear housing 6, as known in the art.

The worm assembly includes a feed worm 28 which transfers the material to be processed through the drainage sections 14 and 16 and out through the extruder section 18 via an outlet die plate member 30 such that the material forced through the die is formed into pellets or the like.

In operation of the press apparatus for dewatering or drying chunks of material to be processed, such as rubber or the like, the material is fed into the inlet opening 22 and is advanced through the barrel 6 via the worm assembly 24. As the material is advanced through the barrel, moisture is expressed from the material and discharged through the drainage sections 14 and 16 so that relatively dry material is extruded from the extruder section 18 to provide pellets or the like via die plate member 30, as is conventional in the art.

Figure 3:
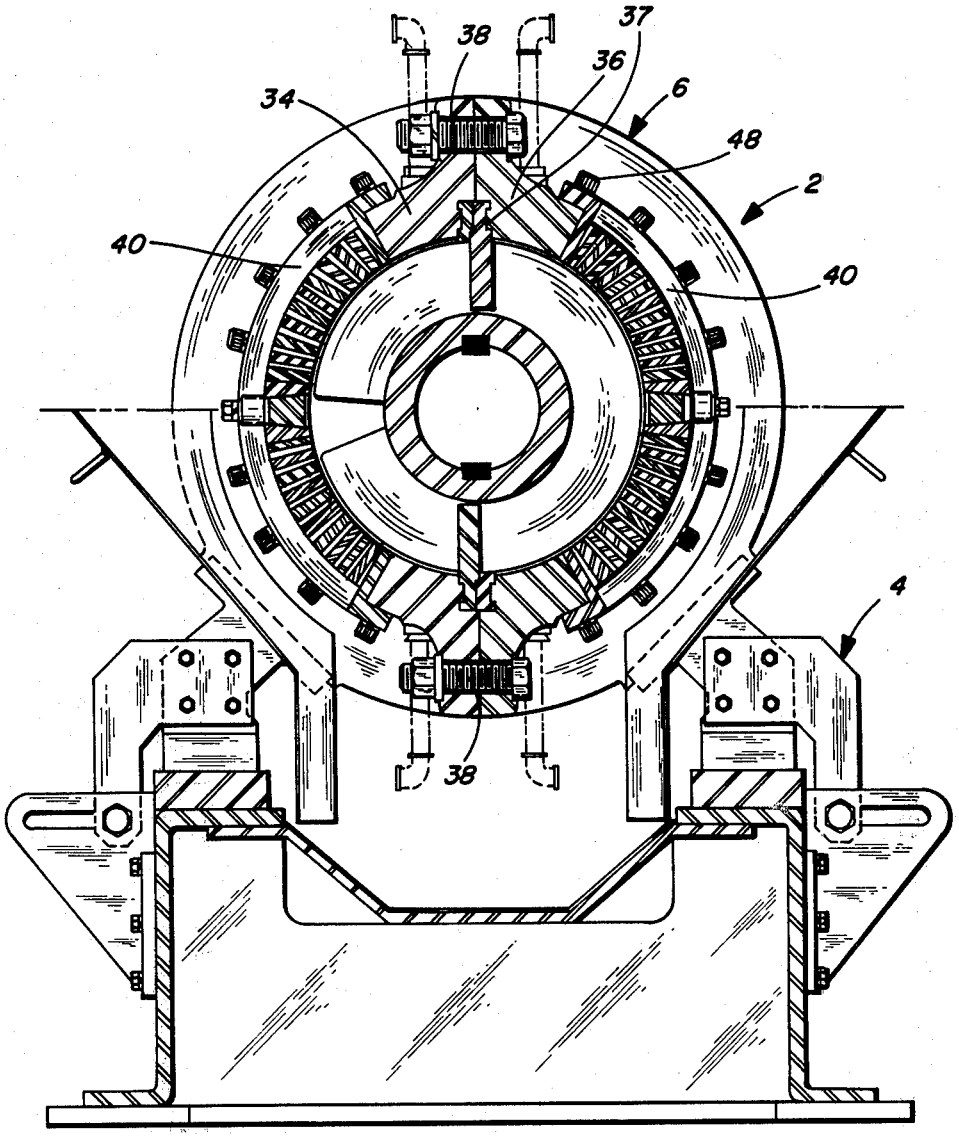
FIG. 3 is a vertical section view, on an enlarged scale, taken along the line 3—3 of FIG. 1.
Figure 4:
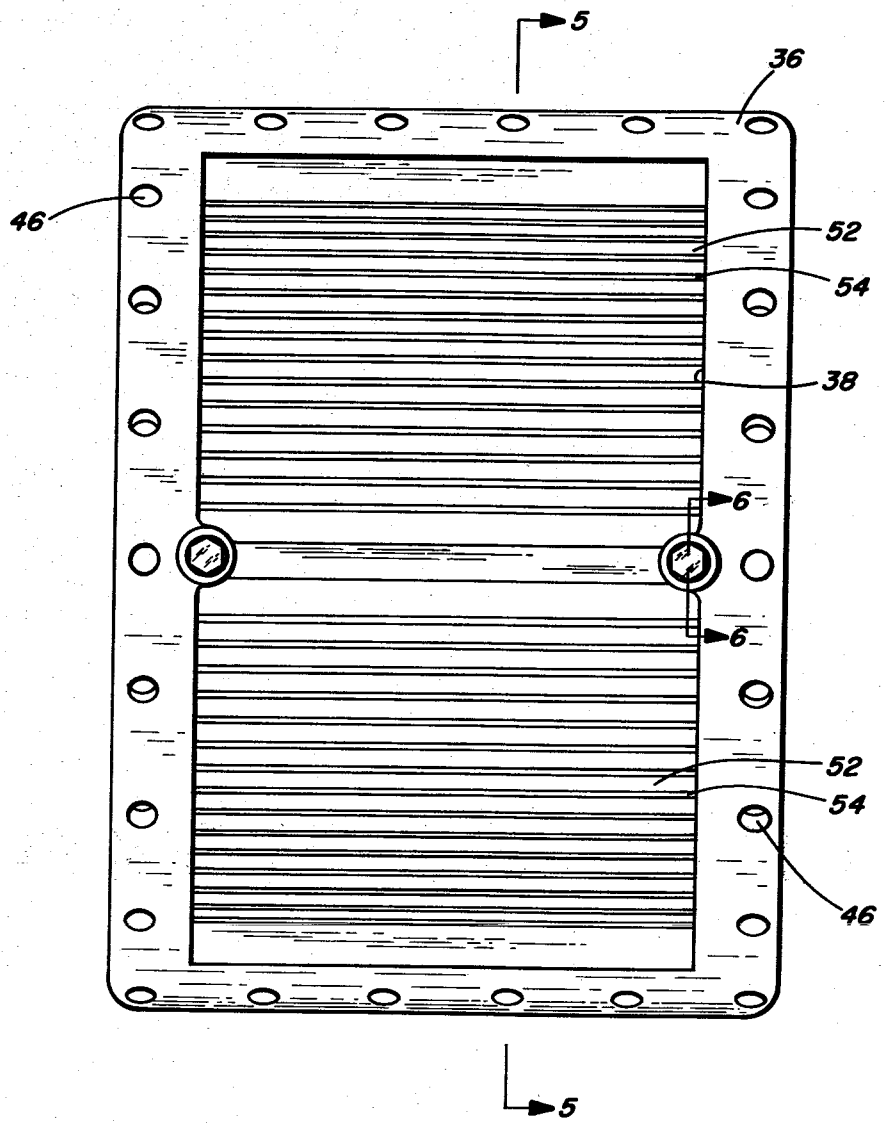
FIG. 4 is a side elevation view showing one of the window-like cage members made in accordance with the invention.
Figure 5:
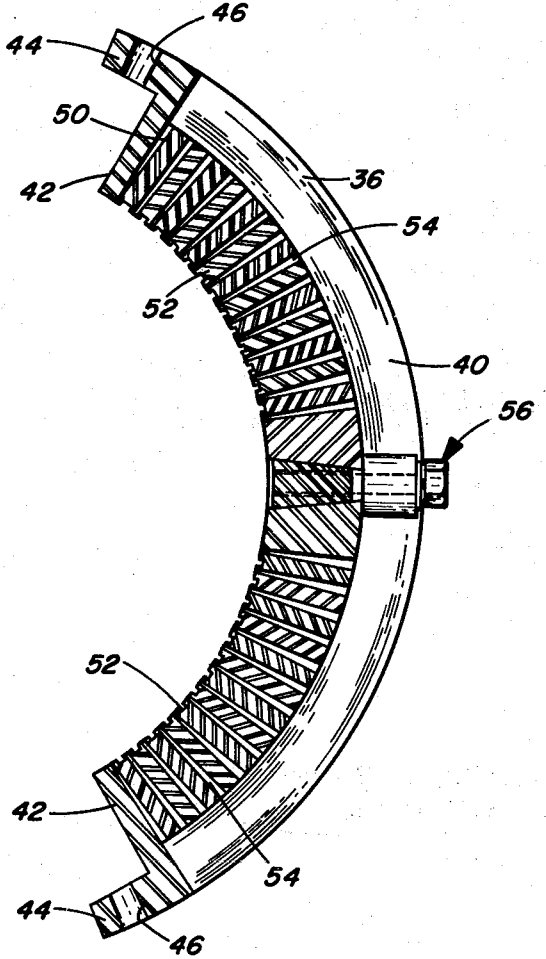
FIG. 5 is a vertical section view taken along the line 5—5 of FIG. 4.

Now in accordance with the invention, there is provided a novel window-like cage assembly which may be employed with the drainage sections 14 and 16. Since the cage assemblies are of an identical construction the following description will proceed with reference to one of the sections 32 wherein like reference numerals refer to like parts. As shown, each of the assemblies 32 includes a pair of semi-cylindrical mating cage members 34 and 36 (FIG. 3) which may be clamped together by a series of tie bolts 38 which extend within holes 40 provided in the frame 4, as best seen in FIG. 1. Each cage section mounts an externally removeable, and inexchangeable window-like panel of semi-cylindrical configuration which provides access to the interior of the barrel 6. The panels 40 are each of a polygonal, such as rectangular configuration, in elevation (FIG. 4) and have window-like openings 38 of polygonal, such as rectangular, configuration. The panels include integral, upstanding end flange members 42 which extend from integral base portions 44 (FIG. 5) which have aperatures 46 adapted to receive bolts 48 (FIG. 3) for securing the panels to the corresponding semi-cylindrical cage sections 34 and 36. The flanges 42 preferably extend substantially at right angles to the base portions 44 and provide generally flat abuttment surfaces 50 (FIG. 5) for resiliently supporting a plurality of axially extending elongated screen bar elements 52 which are mounted on the respective panels 36. The elements 52 are preferably circumferentially spaced to define longitudinally extending drainage slots 54 there between. A series of center bars 37 (FIG. 3) may be provided between the mating numbers 34 and 36 to act as breaker lugs.

Figure 6:
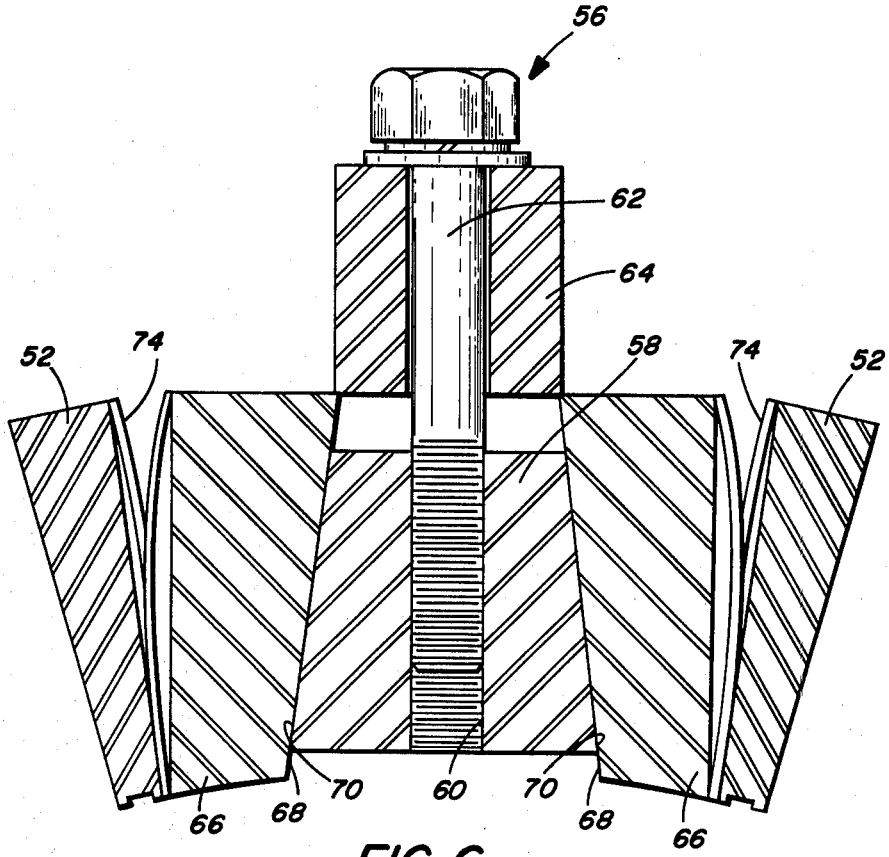
FIG. 6 is an enlarged vertical section view taken along line 6—6 of FIG. 4 illustrating the screen bar elements mounted in the cage assembly of the invention.

In the invention, the screen bar elements 52 are preferably secured within each of the respective panels 40 by means of an adjustable wedge assembly, designated generally at 56, which holds the screen bar elements 52 in circumferentially spaced relation for removal, as a unit, with the respective panel from the exterior of the barrel 6. Each wedge assembly 56 preferably includes an elongated generally frustro-conical wedge block member 58 (FIG. 6) having a threaded hole 60 adapted to receive a bolt 62 which extends through an annular collar 64 for selectively moving the wedge block 58 radially inwardly and outwardly for maintaining a predetermined circumferential pressure on the screen bar elements 52. The assembly 56 further includes a pair of oppostively disposed, elongated and longitudinally extending cam-like wedge blocks 66 that have oppositely inclined surfaces 68 for caming engagement with the confronting surfaces 70 (FIG. 6) on the wedge block 58. Preferably, the wedge block 58 has a reduced transverse (radial) dimension relative to the member 66 so as to provide adequate clearance for circumferential adjustment of the screen bar elements 52 upon radial movement of the wedge block 58 in relation to the cam-like wedge blocks 66.

Figure 7:
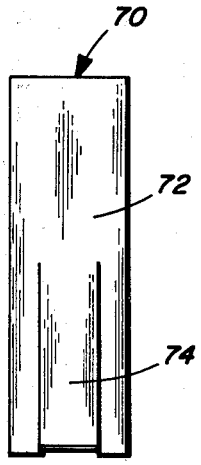
FIG. 7 is an elevation view illustrating one of the resilient retainer elements of the invention.
Figure 8:
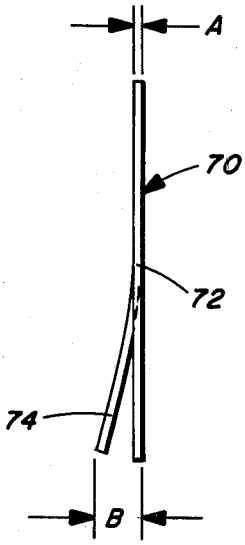
FIG. 8 is a side elevation view looking from the right-hand side of FIG. 7.

In accordance with the invention, the screen bar elements 52 are maintained in circumferentially spaced relation by resilient retention spring members 70 made from spring-steel or the like. Preferably, the members 70 include a generally flat body 72 (FIGS. 7 and 8) having a struck-out integral resilient arm portions 74 which provide a resilient spring clearance area, designated generally at B, of a generally Y-shaped configuration for holding the screen bar elements 52 in resiliently circumferentially spaced relationship for maintaining a predetermined drainage area through the slots 54 for passage of expressed fluids while retaining the solid parts in the press.

In the preferred form, there are two sets of stacked screen bar elements 52 in each of the panels 40, but this arrangement can be modified, as desired. In the invention, one need only remove the panels 40 by removing the bolts 48 without the need to remove the entire mating sections 34 and 36 via bolts 38. This eliminates the need to remove the individual bar elements 52 thereby to save repair and machine down-time.

It will be understood that it is within the scope of the invention to provide any number of the window-like cage assemblies of the invention in the drainage sections of the press apparatus and any number of screen bar elements within each of the assemblies, as desired. Accordingly, it will be understood that the invention is not limited to these specific forms of apparatus, and that changes may be made therein without departing from the scope of the invention.

I claim:

1. In a screw press apparatus of the type for expressing liquid from a processed material including at least one drainage section for receiving the material to be processed therethrough including, in combination, a removable window-like cage assembly to provide a liquid drainage system which is accessible for removal completely from the exterior of the apparatus, said window-like cage assembly including at least pair of generally semi-cylindrical panel members each having a polygonal window-like opening, each panel including a plurality of parallel elongated screen bar elements circumferentially mounted within the opening of said panel so as to extend radially in respect to the longitudinal central axis of the press, selectively adjustable means adapted for detachably connecting each of said panels to the press apparatus to enable the panels to be removed completely from the exterior of said apparatus, resilient spring means disposed as spacers between adjacent of said screen bar elements adapted for maintaining said screen bar elements in resilient circumferentially spaced relationship within each of said panels, selectively adjustable wedged block means adapted for camming co-acting engagement for holding said screen bar elements in circumferentially spaced relationship within said window-like openings, said wedge-block means being disposed centrally of said screen bar elements and including a radially adjustable wedge-block member and a pair of elongated cam-like wedge block members disposed on either side of said adjustable wedge block member adapted for selective radial movement toward and away from the longitudinal central axis of said press apparatus for circumferentially moving associated of said screen bar elements resiliently toward and away from one another for selectively maintaining a predetermined circumferential pressure on said screen bar elements thereby to give a predetermined drainage area through the spaces between adjacent of said screen bar elements.

2. In a screw press apparatus in accordance with claim 1, wherein said wedge block means includes a centrally disposed generally frustro-conical wedge block member adapted for selective radial movement inwardly and outwardly in respect to the longitudinal central axis of the press apparatus, a pair of oppositely disposed, elongated and radially extending cam-like wedge block members that define oppositely inclined surfaces for camming engagement with the confounding surfaces on the central wedge block member, and said cam-like wedge block members adapted for circumferentially adjusting said screen bar elements upon radial movement of said central wedge block member toward and away from the central longitudinal axis of said press apparatus.

3. In a screw press apparatus in accordance with claim 2, wherein said central wedge block member includes an inner frustro-conical wedge block member and an outer collar member with screw means operably associated with said members for selectively moving said inner wedge block member radially inwardly and outwardly for camming said cam-like wedge block members inwardly and outwardly in a circumferential direction.

4. In a screw press apparatus in accordance with claim 1, wherein said resilient spring means includes a generally flat body having struck-out integral arm portions which define a resilient spring clearance area of a generally Y-shaped configuration for holding said screen bar elements in a resiliently circumferentially spaced relationship.

5. In a screw press apparatus in accordance with claim 4, wherein one of said spring means is disposed between each pair of associated of said screen bar elements.

* * * * *

UNITED STATES PATENT AND TRADEMARK OFFICE

CERTIFICATE OF CORRECTION

PATENT NO. : 4,297,943

DATED : November 3, 1981

INVENTOR(S) : Victor R. Laurich-Trost

It is certified that error appears in the above—identified patent and that said Letters Patent is hereby corrected as shown below:

Column 1, line 35, "at" should be -- as --;
line 43, "produced" should be -- produces --.

Column 2, line 25, "aperatures" should be -- apertures --;
line 51, "aperatures" should be -- apertures --.

Column 3, line 6, "aperatures" should be -- apertures --;
line 37, "particular" should be -- particularly --;
line 45, "gage" should be -- cage --.

Column 4, line 22, "aperatures" should be -- apertures --.

Signed and Sealed this

Third Day of May 1983

[SEAL]

*Attest:*

GERALD J. MOSSINGHOFF

*Attesting Officer*

*Commissioner of Patents and Trademarks*